US008727120B2

(12) United States Patent
Caron et al.

(10) Patent No.: US 8,727,120 B2
(45) Date of Patent: May 20, 2014

(54) PACKAGING

(75) Inventors: Sophie Caron, Fresnes (FR); Fabien Guyot, Chécy (FR)

(73) Assignee: Mondelez UK Holdings & Services Limited, Uxbridge (GB)

( * ) Notice: Subject to any disclaimer, the term of this patent is extended or adjusted under 35 U.S.C. 154(b) by 97 days.

(21) Appl. No.: 12/740,056

(22) PCT Filed: Oct. 23, 2008

(86) PCT No.: PCT/GB2008/003580

§ 371 (c)(1),
(2), (4) Date: Apr. 27, 2010

(87) PCT Pub. No.: WO2009/056798

PCT Pub. Date: May 7, 2009

(65) Prior Publication Data

US 2011/0155624 A1 Jun. 30, 2011

(30) Foreign Application Priority Data

Nov. 1, 2007 (GB) ..... 0721441.4

(51) Int. Cl.
*B65D 73/00* (2006.01)

(52) U.S. Cl.
USPC ..... 206/468; 206/800

(58) Field of Classification Search
USPC ..... 206/467, 532, 533, 540, 245, 250, 468, 206/111, 461, 462, 464, 536, 800
See application file for complete search history.

(56) References Cited

U.S. PATENT DOCUMENTS

| | | | | |
|---|---|---|---|---|
| 2,353,629 | A * | 7/1944 | Apfelbaum | 206/536 |
| 3,812,963 | A | 5/1974 | Zahuranec et al. | |
| 4,126,224 | A * | 11/1978 | Laauwe et al. | 206/540 |
| 4,971,203 | A * | 11/1990 | Weinstein | 206/536 |
| 7,147,127 | B2 * | 12/2006 | Lepke et al. | 221/4 |
| 7,216,764 | B2 * | 5/2007 | Forman | 206/497 |
| 7,228,968 | B1 * | 6/2007 | Burgess | 206/494 |

(Continued)

FOREIGN PATENT DOCUMENTS

| | | | |
|---|---|---|---|
| DE | 2065108 | A1 | 8/1972 |
| EP | 1426298 | A1 | 9/2004 |
| GB | 2346365 | A | 9/2000 |
| GB | 2422820 | A | 9/2006 |

*Primary Examiner* — Luan K Bui
*Assistant Examiner* — Rafael Ortiz
(74) *Attorney, Agent, or Firm* — Hoffmann & Baron, LLP

(57) ABSTRACT

Packaging comprises a blister pack (12) and a cover (14) slidably mounted to the pack. The blister pack has a base (16) defining a pocket (18) for receiving a plurality of items and a closure sheet (24) overlaying a front face of the base. A discrete opening region (26) is defined in the closure sheet. The cover (14) has a dispensing aperture (40) and is movable between a dispensing position in which the dispensing aperture (40) is aligned with the dispensing opening region (26) and a closed position in which the dispensing aperture (40) is offset from the dispensing opening region (26). In one embodiment, the opening region (26) is defined by means of lines of weakness (28) formed in the closure sheet and the inner surface of the cover (14) is bonded to the closure sheet so that on first movement of the cover (14) to the dispensing position, the material in the dispensing opening region (26) is removed to form a dispensing opening in the closure sheet which aligns with the dispensing aperture.

15 Claims, 4 Drawing Sheets

(56) References Cited

U.S. PATENT DOCUMENTS

| | | | | |
|---|---|---|---|---|
| 7,648,024 | B2 * | 1/2010 | Mitten et al. | 206/236 |
| 7,757,843 | B2 * | 7/2010 | Katsis | 206/1.5 |
| 8,016,105 | B2 * | 9/2011 | Sendo | 206/264 |
| 2002/0014431 | A1 * | 2/2002 | Logan et al. | 206/467 |
| 2002/0074387 | A1 | 6/2002 | Stewart et al. | |
| 2003/0085262 | A1 * | 5/2003 | Evans et al. | 229/102 |

* cited by examiner

PACKAGING

TECHNICAL FIELD OF THE INVENTION

The present invention relates to packaging and in particular but not exclusively to packaging for confectionery items such as gum pellets.

BACKGROUND TO THE INVENTION

Chewing gum is available to consumers in a variety of different formats. These include stick gum, slab gum, pellet gum, extruded gum, and others.

A range of packaging for gum is also available, some used predominantly in relation to one or other of the gum formats. Gum pellets are typically packaged together in a carton or dispenser that can be opened to dispense one or more pellets at a time. It is also known to package gum pellets in a so called blister pack. Typically, a blister pack comprises a base of plastic in which a number of pockets or cavities are formed. Individual gum pellets are placed in each pocket and a sheet of foil or other material is attached to the base to contain and preferably seal the pellets in the pockets. The consumer can remove individual pellets one at a time by pushing them out of their pockets through the foil whilst the remaining pellets remain sealed within their pockets. Whilst it can be advantageous to have gum pellets individually sealed in a separate pocket; such packaging is comparatively expensive and can be very bulky if a large number of pellets are to be contained in the packaging.

It is also known to provide a blister pack having a single pocket for receiving a number of items. This provides a less costly and less bulky method of packaging a large number of items but has the disadvantage that once opened it can be difficult to retain the remaining items in the pocket.

It is an objective of the present invention to provide an improved packaging which overcomes, or at least mitigates, the drawbacks of the known packaging.

SUMMARY OF THE INVENTION

In accordance with the invention, there is provided packaging comprising a blister pack having a base defining a pocket for receiving a plurality of items and a closure sheet overlaying a front face of the base to close the pocket and retain the items therein, the closure sheet having a dispensing opening region, a cover displaceably mounted to the pack so as to overlie the closure sheet and having a dispensing aperture, the cover being movable relative to the pack between a dispensing position in which the dispensing aperture is aligned with the dispensing opening region and a closed position in which the dispensing aperture is offset from the dispensing opening region.

The dispensing opening region is preferably defined therein by means of one or more lines of weakness in the closure sheet. In which case, a region of the cover which overlies the dispensing opening region when the cover is in the closed position may be adhered to the closure sheet within the dispensing opening region, the arrangement being such that on first movement of the cover from the closed position towards the dispensing position, material of the closure sheet within the dispensing opening region is removed to produce a dispensing opening through which items in the pack can be dispensed when the dispensing aperture is aligned with the dispensing opening.

The cover may overlie the dispensing opening region when the cover is in the closed position, the arrangement being such that in the closed position the cover retains items in the pocket when a dispensing opening is present within the dispensing opening region.

The dispensing aperture in the cover may be arranged to form a window through which items in the blister pack can be viewed when the cover is in the closed position. In which case, at least a region of the closure sheet which aligns with the dispensing aperture when the cover is in the closed position may be transparent.

The cover may be slidably mounted to the blister pack for movement between the dispensing and closed positions.

The cover and blister pack may have corresponding abutments to limit movement of the cover relative to the pack.

The cover may be formed from a blank of foldable material such as paperboard or cardboard.

The cover may be in the form of a sleeve which encircles the blister pack about four sides.

The closure sheet may be heat sealed or glued to the base.

The packaging may be adapted to package confectionery items, especially gum pellets.

DETAILED DESCRIPTION OF THE INVENTION

Several embodiments of the invention will now be described, by way of example only, with reference to the accompanying drawings in which.

In the following description, the same reference numerals but increased by 100 in each case will be used to denote the same features or features which fulfil the same function in each embodiment.

Figure 1:
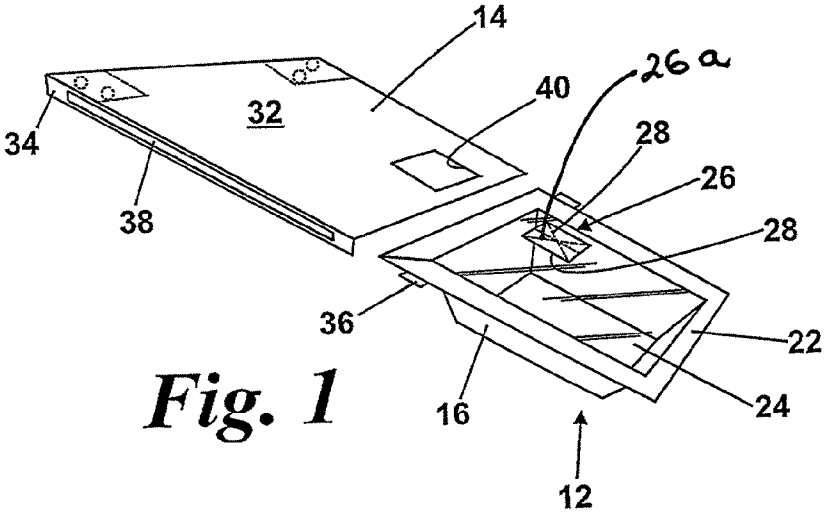
FIG. 1 is an exploded perspective view of a blister pack and cover forming packaging in accordance with a first embodiment of the invention.
Figure 3:
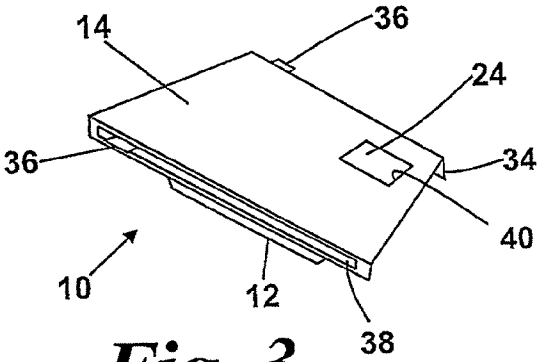
FIG. 3 is a view similar to that of FIG. 2 but showing the cover in a closed position.
Figure 2:
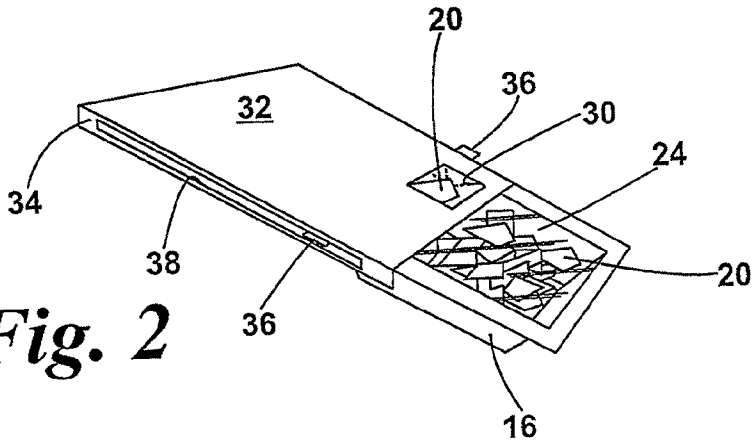
FIG. 2 is a perspective view of the packaging of FIG. 1 showing the cover mounted to the blister pack with the cover in a dispensing position.

FIGS. 1 to 3 illustrate packaging 10 in accordance with a first embodiment of the invention comprising a blister pack 12 and a cover 14.

The blister pack 12 has a base member 16 defining a pocket 18 for receiving a plurality of items such as chewing gum pellets 20. The base member can be made from any suitable material but is advantageously made from plastics. The base member has a flange portion 22 surrounding an open face of the pocket 18 and a closure sheet 24 is mounted to the flange portion 22 so as to overlie the open face closing the pocket. The closure sheet is affixed to the flange 22 after the pellets 20 have been introduced into the pocket so as to close the pocket and retain the pellets 20 inside. The closure sheet 24 can be made of any suitable material such as plastic (including bio-plastic), aluminium or other metal foil, paper based material or a multi-layer composite material. The closure sheet can be affixed to the flange by any suitable means but is preferably glued or heat sealed to the flange.

The closure sheet 24 has a dispensing opening region 26 which is defined by lines of weakness 28 in the material of the sheet 24. All or part of the material within the dispensing opening region 26 can be removed by tearing the sheet along the lines of weakness 28 to create a dispensing opening 30 through which the pellets 20 can be dispensed. The remainder of the closure sheet 24 remains intact when the dispensing opening 30 has been formed to help retain any remaining pellets 20 in the pocket.

The lines of weakness 28 can be formed by any suitable means such as scoring, laser etching or by producing perforations. However, it is preferred that the lines of weakness to not destroy the integrity of the closure sheet 24 so that the contents remain sealed in the pocket until the blister pack is opened by a consumer. For example, where the closure sheet 24 is a multi-layer composite, the lines of weakness 28 may extend though one or more of the layers only whilst at least one other layer remains intact.

The cover 14 is mounted to the blister pack 12 for movement between a closed position as shown in FIG. 3 and a dispensing position as shown in FIG. 2. In the present embodiment, the cover 14 is mounted so as to slide relative to the blister pack 12 between the dispensing and closed positions but other arrangements can be adopted.

The cover 14 can be made from any suitable material but is advantageously made from a blank of foldable material such as paperboard or cardboard. The exterior surface of the cover 14 may contain printed matter to identify the contents of the pack and to provide other information for the consumer.

The cover 14 has a main panel 32 which overlies the closure sheet 24 and two short side panels 34 which extend at approximately 90 degrees to the main panel 32 partway down opposing sides of the blister pack. The cover is retained on the blister pack by means of a pair of tabs 36 on the pack 16 which engage in respective slots 38 in each of the slide panels 34. Engagement of the tabs 36 in the slots 38 limits the sliding movement of the cover 14 relative to the pack 16 and prevents the cover 14 from being removed completely from the blister pack 12.

A dispensing aperture 40 is provided in the main panel 32 of the cover. The dispensing aperture 40 and the dispensing opening region 26 in the closure sheet are positioned so that when the cover 24 is in the dispensing position, as shown in FIG. 3, the dispensing aperture 40 aligns with the dispensing opening region 26. When the cover 14 is in the closed position, the dispensing aperture 40 is off-set from the dispensing opening region 26, which is covered by another part of the main panel 32.

In use, the packaging 10 will be supplied to the consumer with the cover 14 in the closed position and the dispenser opening region 26 intact so that the gum pellets 20 are sealed within the pocket. To open the packaging 10, the consumer slides the cover 14 to the dispensing position so that the dispensing opening region 26 is exposed within the dispensing aperture 40. The consumer is than able to tear the closure sheet 24 along the lines of weakness 28 to remove some all of the material within the dispenser opening region 26 to create a dispensing opening 30. One or more of the pellets 20 in the pocket can then be dispensed through the aligned dispensing opening 30 in the closure sheet 24 and the dispensing aperture 40 in the cover. Once the consumer has dispensed a required number of gum pellets 20, the packaging 10 can be closed by moving the cover 14 to the closed position. Because the dispensing aperture 40 is off-set from the dispensing opening 30 when the cover is moved to the closed position, the remaining gum pellets 20 are safely retained in the pocket. To dispense further pellets 20, the consumer simply slides the cover 14 back to the dispensing position so that the dispensing aperture 40 and the dispensing opening 30 are aligned once again.

In a modification, the cover 14 is assembled to the blister pack 16 in the closed position and an inner surface of a region of the main panel 32 which overlies the dispensing opening region 26 is adhered to the material of the closure sheet 24 within the dispensing opening region 26 by, for example, adhesive 26*a*. With this arrangement, some or all of the material within the dispensing opening region 26 is automatically removed to create a dispensing opening 30 when the cover 14 is first moved to the dispensing position by the consumer.

The packaging 10 thus provides a simple and effective re-closable blister pack arrangement. The packaging is particularly suitable for use in packaging chewing gum or other confectionery or perishable products as the closure sheet 24 remains intact, sealing the pocket 18, until first opened by the consumer. This helps to increase the shelf life of such products.

Whilst the packaging 10 is particularly suitable for use in packaging perishable products, it can be used to package a variety of different products where the ability to re-close the packaging is of advantage. For applications in which the products are not required to be sealed, a dispensing opening 30 may be preformed in the dispenser opening region 26.

It will be appreciated that the dispensing aperture 40 need not fully correspond with the dispensing opening region/dispensing opening 26, 30 when the cover 14 is moved to the dispensing position, provided that they overlap sufficiently that the contents 20 of the pocket 18 can be dispensed. References in the description and claims to the dispensing aperture 40 and dispensing opening region/dispensing opening 26, 30 being "aligned" or the like should be construed accordingly.

When the cover 14 is in the closed position, the dispensing aperture 40 can be used to provide a window through which a consumer can view the contents 20 of the pack 12. In this case, the closure sheet 24, or at least that region of the sheet which corresponds with the dispensing aperture 40 when the cover is closed, will be transparent.

FIGS. 4 to 12 show three further embodiments of the invention which illustrate alternative means of retaining the cover on the blister pack. In all other respects, the packaging in accordance with the further embodiments is in essence the same as the packaging 10 of the first embodiment as described above. In the following description, only those features of the packaging which differ from the first embodiment will be described in detail. Accordingly, the reader should refer to the above description of the first embodiment 10 for further details, particularly in relation to the construction of the blister pack and closure sheet and the method of opening the packaging by aligning the dispensing aperture with the dispensing opening region.

Figures 4, 5, 6:
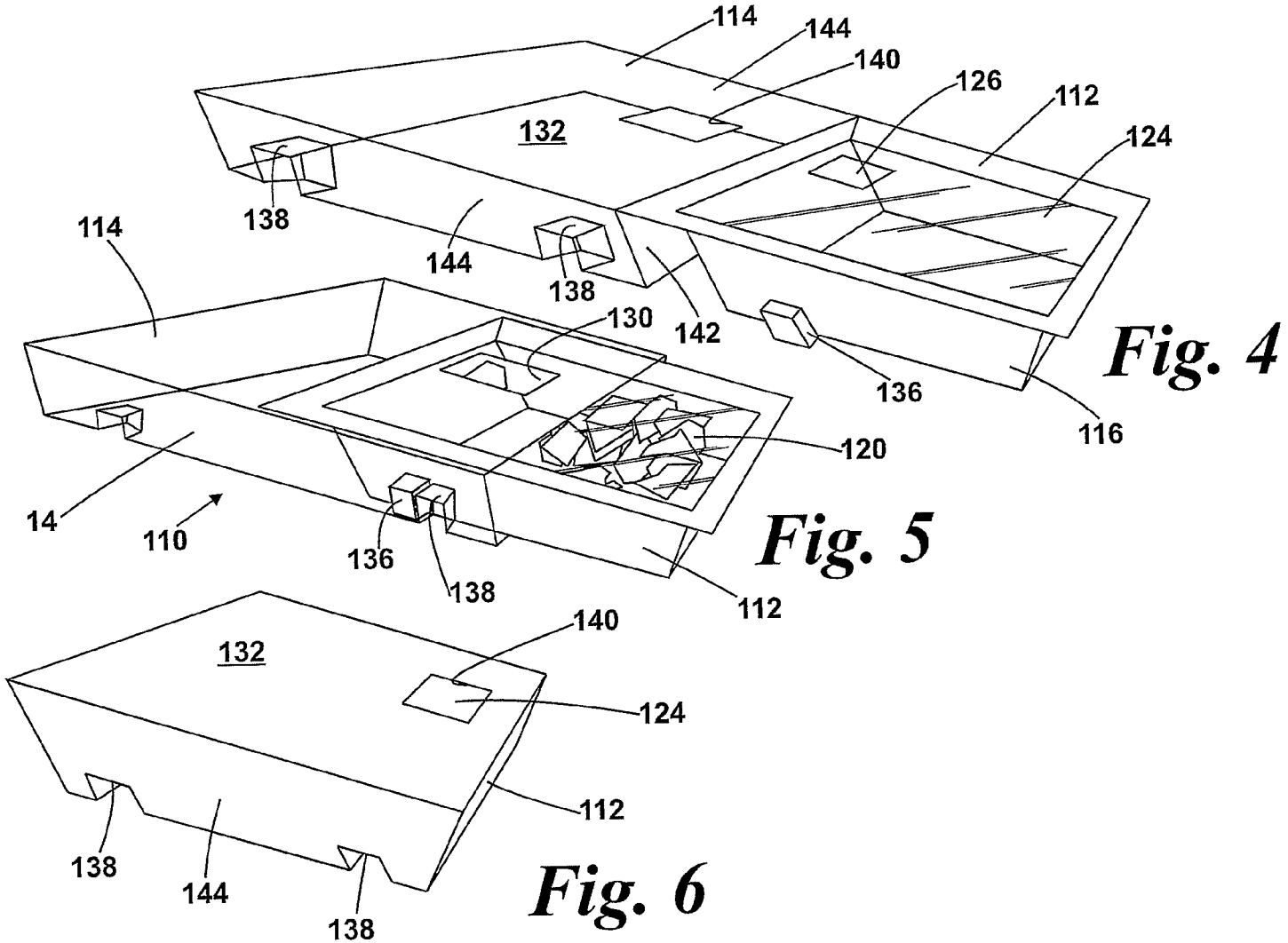
FIG. 4 is a exploded perspective view of a blister pack and cover forming packaging in accordance with a second embodiment of the invention, the cover being shown in transparent outline.
FIG. 5 is a perspective view of the packaging of FIG. 4 showing the cover mounted to the blister pack with the cover in a dispensing position, the cover being shown in transparent outline.
FIG. 6 is a view similar to that of FIG. 5 but showing the cover in a closed position.

The second embodiment of a packaging 110 in accordance with the invention is illustrated in FIGS. 4 to 6 and comprises a blister pack 112 and a cover 114. In the second embodiment 110, the cover 114 is provided in the form of a sleeve member which encircles the blister pack 112 about four sides. The cover 114 has a first main panel 132 which overlies the closure sheet 124 of the blister pack 112 and an opposing second main panel 142, the two main panels being joined by two side panels 144. Each of the side panels 144 has a pair of abutments 138 which project inwardly and the base 116 of the blister pack has corresponding abutments 136 which project outwardly from either side for engagement between the abutments 138 on the respective side panel 144. Contact between the abutments 136 on the blister pack and the abutments 138 on the side panels of the cover limit the sliding movement of the cover 114 relative to the blister pack 112 to prevent the cover 114 from being accidentally removed from the pack 112. The abutments 136, 138 could be provided on only one side is desired.

The cover 114 is preferably made from a blank of foldable material and each of the abutments 138 is formed by producing two spaced, generally parallel cuts 146 in the blank which extend across the intersection of the respective side panel 144 and the second main panel 142. The material between the cuts is then pressed inwardly to produce the abutment. Thus the blank with pre-formed cuts can be formed into a sleeve 114 and the blister pack 112 inserted before the abutments 138 are pressed inwardly into position to prevent unwanted removal of the cover 114 from the blister pack 112.

The construction and operation of the packaging 110 is otherwise largely the same as the packaging 10 of the first embodiment including the provision of a dispensing aperture 140 in the first main panel 132 which aligns with a dispensing opening region 126 in the closure sheet 124 when the cover 114 is in the dispensing position. The dispensing opening region 126 is defined by lines of weakness in the closure sheet 124 and the material within the region may be adhered to the cover 114 initially so that a dispensing opening 130 is produced automatically when the cover is first moved to the dispensing position by a consumer.

Figure 7:
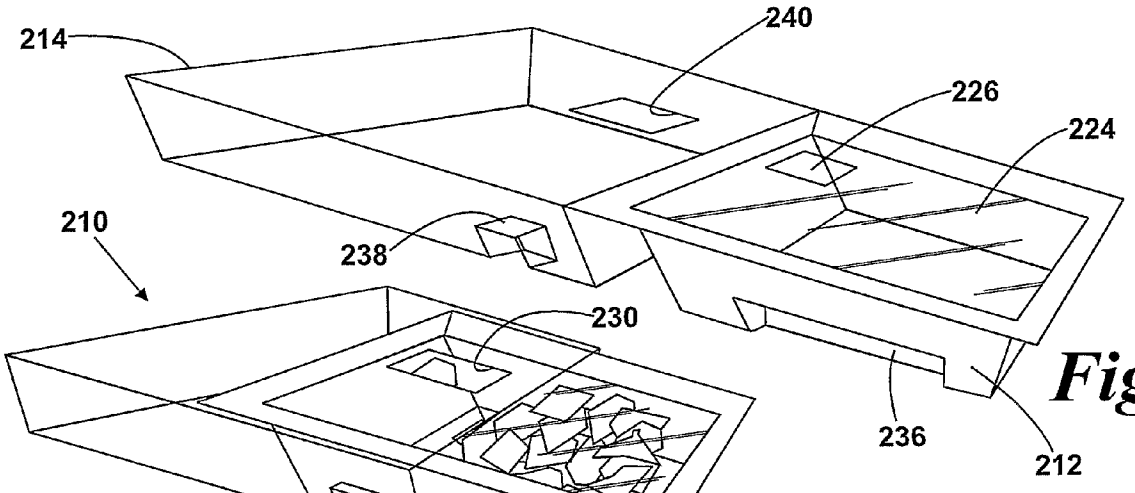
FIG. 7 is a exploded perspective view of a blister pack and cover forming packaging in accordance with a third embodiment of the invention, the cover being shown in transparent outline.
Figure 8:
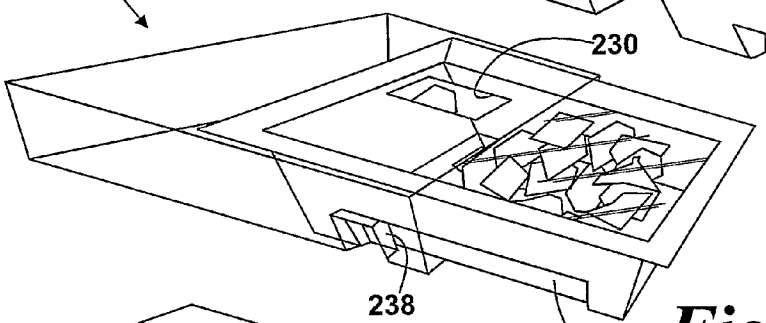
FIG. 8 is a perspective view of the packaging of FIG. 7 showing the cover mounted to the blister pack with the cover in a dispensing position, the cover being shown in transparent outline.
Figure 9:
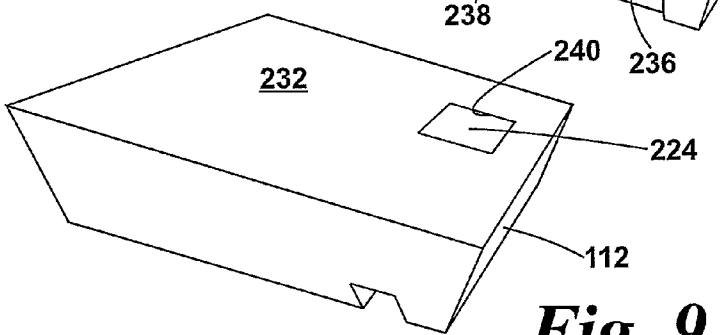
FIG. 9 is a view similar to that of FIG. 8 but showing the cover in a closed position.

FIGS. 7 to 9 show packaging 210 in accordance with a third embodiment of the invention.

The packaging 210 is similar to the packaging 110 in accordance with the second embodiment except for the abutment arrangement for limiting the sliding movement of the cover 214 relative to the blister pack 212. In this embodiment, the cover 214 is again in the form of a sleeve but in this case a single abutment 238 is provided on either side of the cover for location in a corresponding groove 236 in a respective side of the base 216 of the blister pack. The cover 214 is produced from a blank of foldable material and the abutments 238 in the cover 214 are formed in the same manner as those described above in relation to the second embodiment 110. Thus the blank is first formed into a sleeve 214 and the blister pack 216 inserted. The abutments 238 are then pressed inwardly into position in their respective grooves 136 to prevent the cover from be accidentally removed.

In FIGS. 4, 5, 7 & 8, the cover 114, 214 is shown in transparent outline so that details of the abutment arrangements can be seen more clearly.

Figure 10:
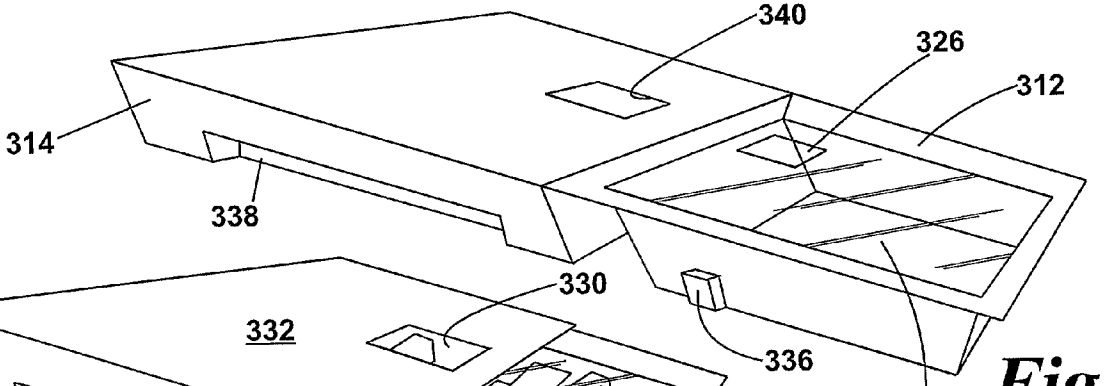
FIG. 10 is a exploded perspective view of a blister pack and cover forming packaging in accordance with a fourth embodiment of the invention.
Figure 11:
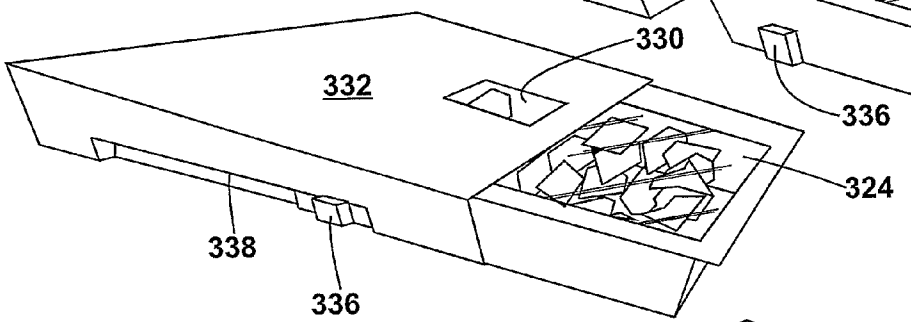
FIG. 11 is a perspective view of the packaging of FIG. 10 showing the cover mounted to the blister pack with the cover in a dispensing position; and, FIG. 12 is a view similar to that of FIG. 11 but showing the cover in a closed position.
Figure 12:
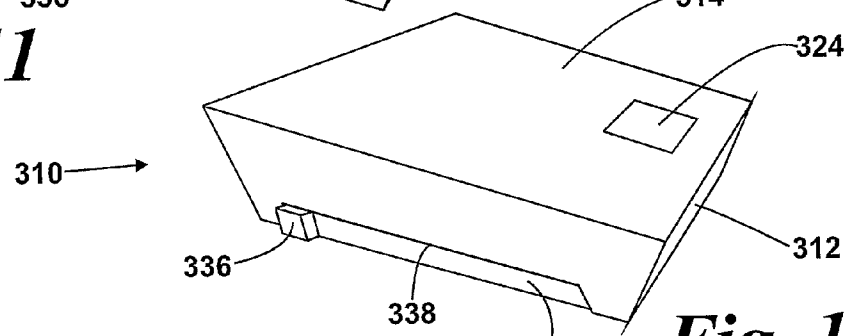

A fourth embodiment of a packaging 310 in accordance with the invention is shown in FIGS. 10 to 12. The packaging 310 is similar to the packaging 110, 210 in accordance with the previous two embodiments but illustrates a further alternative method of retaining the cover sleeve 314 on the blister pack 312. Thus in this embodiment, abutments 336 projecting from opposing sides of the base 316 engage in slots 338 in the cover sleeve 314 to limit the movement of the cover 314 relative to the blister pack 312 and to prevent the cover 314 being unintentionally removed from the pack 312.

The packaging in accordance with the invention is particularly suitable for confectionery items such as chewing gum pellets, pastels, hard gums, mints or the like. However, packaging in accordance with the invention is not limited to use in packaging confectionery items but can be used in packaging almost any items.

Whereas the invention has been described in relation to what is presently considered to be the most practical and preferred embodiment, it is to be understood that the invention is not limited to the disclosed arrangements but rather is intended to cover various modifications and equivalent constructions included within the spirit and scope of the invention.

The invention claimed is:

1. Packaging comprising a blister pack having a base defining a pocket for receiving a plurality of items and a closure sheet overlaying a front face of the base to close the pocket and retain the items therein, the closure sheet having a dispensing opening region, a cover displaceably mounted to the pack so as to overlie the closure sheet and having a dispensing aperture, the cover being movable relative to the pack between a dispensing position in which the dispensing aperture is aligned with the dispensing opening region and a closed position in which the dispensing aperture is offset from the dispensing opening region said dispensing opening region being openable while said cover is mounted to said pack.

2. Packaging as claimed in claim 1, in which the dispensing opening region is defined therein by means of one or more lines of weakness in the closure sheet.

3. Packaging as claimed in claim 2, in which a region of the cover which overlies the dispensing opening region when the cover is in the closed position is adhered to the closure sheet within the dispensing opening region, the arrangement being such that on first movement of the cover from the closed position towards the dispensing position, material of the closure sheet within the dispensing opening region is removed to produce a dispensing opening through which items in the pack can be dispensed when the dispensing aperture is aligned with the dispensing opening.

4. Packaging as claimed in claim 1, in which the cover overlies the dispensing opening region when the cover is in the closed position, the arrangement being such that in the closed position the cover retains items in the pocket when a dispensing opening is present within the dispensing opening region.

5. Packaging as claimed in claim 1, in which the dispensing aperture in the cover provides a window through which items in the blister pack can be viewed when the cover is in the closed position.

6. Packaging as claimed in claim 5, in which at least a region of the closure sheet which aligns with the dispensing aperture when the cover is in the closed position is transparent.

7. Packaging as claimed in claim 1 in which the cover is slidably mounted to the blister pack for movement between the dispensing and closed positions.

8. Packaging as claimed in claim 1, in which the cover and blister pack have corresponding abutments to limit movement of the cover relative to the pack.

9. Packaging as claimed in claim 1, in which the cover is formed from a blank of foldable material such as paperboard or cardboard.

10. Packaging as claimed in claim 9, in which the cover is in the form of a sleeve which encircles the blister pack about four sides.

11. Packaging as claimed in claim 1, in which the closure sheet is heat sealed or glued to the base.

12. Packaging as claimed in claim 1, in which packaging is adapted to package confectionery items.

13. Packaging as claimed in claim 12, in which the confectionery items are gum pellets.

14. Packaging comprising a blister pack having a base defining a pocket for receiving a plurality of items and a closure sheet overlaying a front face of the base to close the pocket and retain the items therein, the closure sheet having a dispensing opening region, a cover displaceably mounted to the pack so as to overlie the closure sheet and having a dispensing aperture, the cover being movable relative to the pack between a dispensing position in which the dispensing aperture is aligned with the dispensing opening region and a closed position in which the dispensing aperture is offset from the dispensing opening region, wherein the dispensing aperture in the cover provides a window through which items in the blister pack can be viewed when the cover is in the closed position, wherein at least a region of the closure sheet which aligns with the dispensing aperture when the cover is in the closed position is transparent, wherein the cover is slidably mounted to the blister pack for movement between the dispensing and closed positions, wherein the cover and blister pack have corresponding abutments to limit movement of the cover relative to the pack.

15. Packaging as claimed in claim 14, in which the cover is in the form of a sleeve which encircles the blister pack about four sides.

* * * * *